United States Patent [19]

Bryson et al.

[11] Patent Number: 4,493,682

[45] Date of Patent: Jan. 15, 1985

[54] APPARATUS AND METHOD FOR FORMING AND DEBOWING CARTONS WITH PINCHING WHEELS

[75] Inventors: John W. Bryson, Los Altos; William H. Hittenberger, San Mateo, both of Calif.

[73] Assignee: Kliklok Corporation, Greenwich, Conn.

[21] Appl. No.: 337,167

[22] Filed: Jan. 5, 1982

[51] Int. Cl.[3] ..... B31B 1/50; B31B 3/26

[52] U.S. Cl. ..... 493/174; 493/137; 493/310; 493/472

[58] Field of Search ..... 493/171, 174, 137, 143, 493/142, 167, 310, 472

[56] References Cited

U.S. PATENT DOCUMENTS

| | | | |
|---|---|---|---|
| 2,819,660 | 1/1958 | Johnson | 493/137 |
| 2,832,270 | 4/1958 | Pierce, Jr. et al. . | |
| 2,863,370 | 12/1958 | Dorfman | 493/137 X |
| 2,864,287 | 12/1958 | Johnson et al. | 493/137 |
| 2,997,930 | 8/1961 | Pierce, Jr. . | |
| 3,102,456 | 9/1963 | Bailey | 493/310 X |
| 3,400,640 | 9/1968 | Randles . | |
| 4,283,190 | 8/1981 | Williams et al. | 493/310 X |

FOREIGN PATENT DOCUMENTS 142489 12/1920 United Kingdom .

OTHER PUBLICATIONS

Previously filed application Collura et al. S.N. 329,878 filed Dec. 11, 1981 Apparatus and Method for Forming and Debowing Cartons.

*Primary Examiner*—James F. Coan

*Attorney, Agent, or Firm*—King, Liles and Schickli

[57] ABSTRACT

An apparatus and method for forming flat cut carton blanks into erected cartons with debowed carton side panels is disclosed. The apparatus includes a forming head receiving and directing a carton blank through forming guides. Pinching wheels rotatably secured adjacent the forming guides include a pinching notch with a leading edge projecting inwardly into the forming head path. The pinching notch engages the descending carton bottom and side panels to capture and pinch the fold lines and overbreak the side panels at the fold lines between the carton side and bottom panels. An inclined surface with a sharp creasing edge abutting the inside of the fold line assists the pinching notch in creasing the fold lines. An extension edge formed adjacent a trailing edge of the pinching notch completes the overbreaking action. A release edge formed adjacent the leading edge gently releases the carton side panels from the overbreaking position upon counter rotation of the wheel. The height of the cutout opening allows each carton side panel to clear the upper periphery of the openings to prevent buckling. After debowing the side panels, a stripping edge of the pinching wheel engages the upper edge of the carton side panel to strip the erected cartons from the forming head during the ascending return stroke. Clearance notches provided in the forming head side walls serve to prevent interference contact between the pinching wheels and the forming head and also improve pinching engagement.

17 Claims, 8 Drawing Figures

Fig. 5
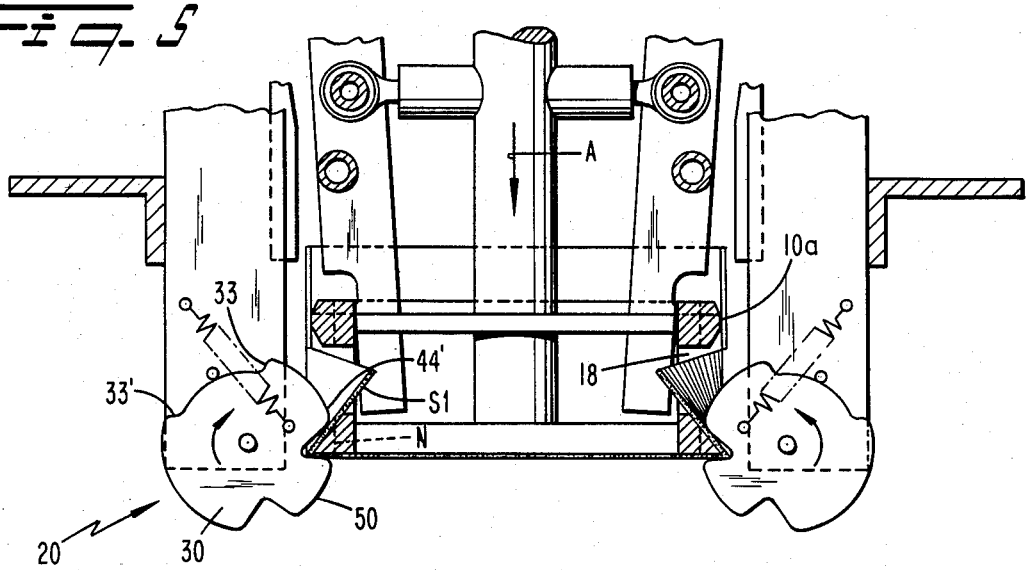
Fig. 6
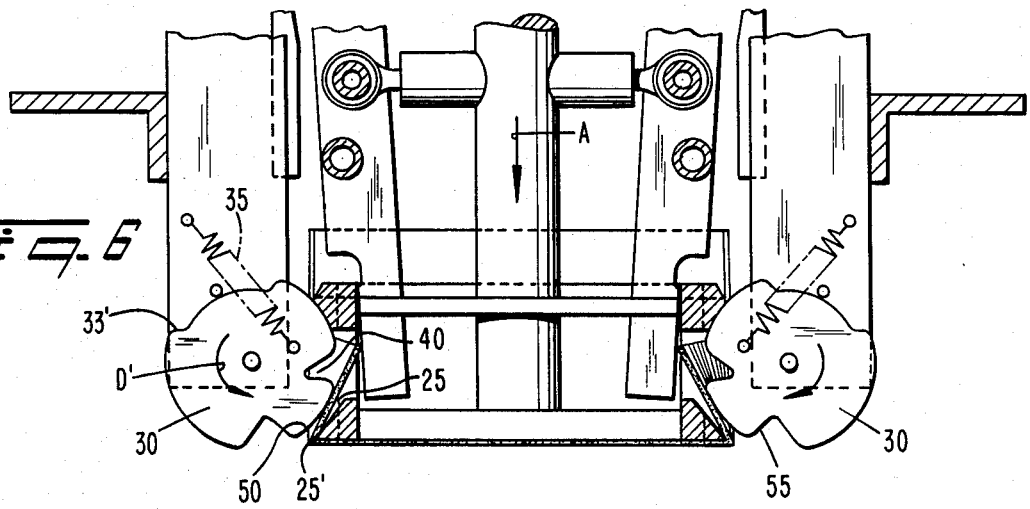
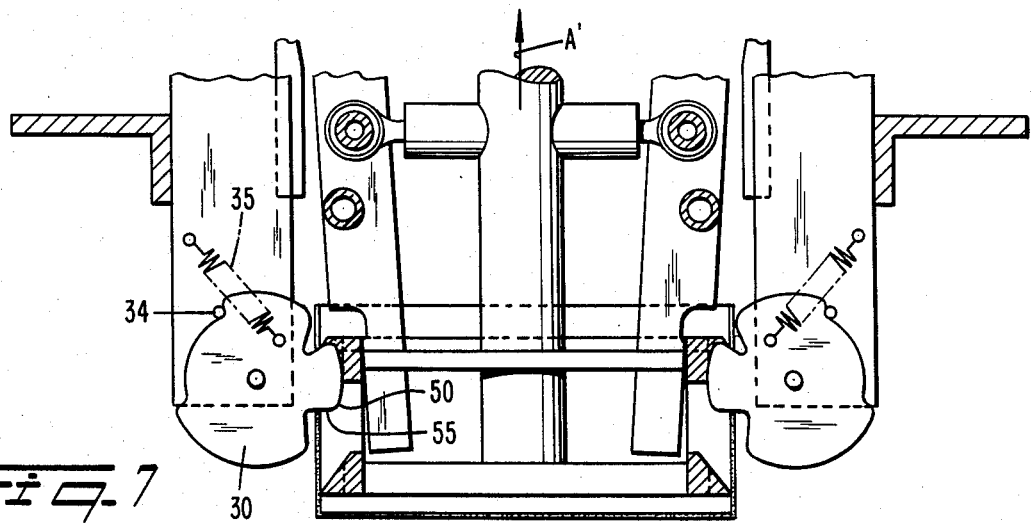
Fig. 7

APPARATUS AND METHOD FOR FORMING AND DEBOWING CARTONS WITH PINCHING WHEELS

BACKGROUND OF THE INVENTION

This invention relates generally to an apparatus and method for forming flat cut carton blanks into erected cartons, and, more particularly, to an apparatus and method for debowing the erected carton side panels during the forming operation.

Apparatus are known for forming flat cut carton blanks into erected cartons. The carton blanks are generally of rectangular configuration having a bottom panel and opposing side and end panels connected therewith along fold lines. Locking tabs are provided on the end panels for engagement with slits provided on the side panels during the forming operation. Locking retention between the tabs and slits serves to maintain the cartons in erected condition for subsequent filling and/or lidding operations.

Known carton forming apparatus typically include a feeder mechanism for depositing a carton blank onto a die. A forming head, or plunger, of rectangular configuration corresponding to the erected carton size, then engages the carton bottom panel to force the blank in a descending forming stroke through the die. The die includes forming guides engaging the carton sides and end panels during passage of the forming head through the die. In this manner, the carton side and end panels gradually bend along their fold lines into upright position relative to the carton bottom panel, in engagement with corresponding end and side walls of the forming head. The die also includes stripper fingers to force the locking tabs into the slits.

During further operation, the forming head descends completely through the die, where spring-loaded fingers, such as the type disclosed in U.S. Pat. No. 2,997,930 to Pierce (owned by the assignee of the present invention) are positioned to project slightly into the path of the forming head. As the forming head descends below the fingers into an end-of-stroke position, the biased fingers engage the upper edges of the carton side panels. Thereafter, the forming head ascends to receive the next in-line carton blank. However, since the carton is now positively arrested by the fingers, the erected carton is stripped from the forming head and dropped onto a suitable conveyor positioned below.

Due to the natural flexural strength or bending memory of the carton side panels, the erected panels sometimes tend to be outwardly bowed after passing through the die, as is shown in FIG. 2*a* of the drawing. Consequently, difficulties are encountered in applying and sealing lids on the erected cartons, resulting in increased production time. Furthermore, in view of the outwardly bowed condition of the side panels, the cartons exhibit less than ideal product retention properties. Also, a carton with bowed sides is unsightly and hinders the sales appeal of product. In the past, where the problem is acute, the only solution is to perform a separate debowing operation on the carton. This, of course, adds considerable expense and slows the carton forming operation.

An improved method and apparatus for debowing the carton side panels during the carton forming process is disclosed in U.S. patent application entitled Apparatus and Method for Forming and Debowing Cartons Ser. No. 329,878, of Collura et al., filed Dec. 11, 1981, commonly assigned with the present invention. In the Collura et al. application, presser fingers pivotally secured to the forming guides are biased into the forming head path with spring means. During descending movement of the forming head, the spring means produces a force sufficient to urge the presser fingers against the fold lines and the carton side panels, thereby creasing the fold lines and overbreaking the panels into cutout openings in the forming head side walls.

While this method and apparatus for debowing the side panels is believed superior to prior methods, due to the stiffness characteristics of certain paperboard, some carton blanks tend to resist the simple spring-loaded pressing action of the presser fingers. Such resistance prevents full debowing action from occurring. Thus, with some carton blanks stronger and more controlled creasing action is needed to assure the necessary overbreaking action of the side panels.

SUMMARY OF THE INVENTION

It is accordingly an object of the present invention to provide an improved method and apparatus for debowing the carton side panels during the carton forming process.

Another object is to provide an apparatus for debowing the side panels using a specially designed forming head and cooperating pressing and pinching means to effect overbreaking of the carton side panels.

Another object is to provide a method and apparatus with means for engaging and capturing the fold lines between the bottom and side panels with pinching action to effect creasing and overbreaking in a positive and unique controlled manner.

Still another object of the present invention is to provide an improved method and apparatus for debowing a carton resulting in increased production of a more desirable, accurately formed carton.

Additional objects, advantages and novel features of the invention will be set forth in detail in part in the description which follows and in part will become apparent to those skilled in the art upon examination of the drawing, or may be learned by practice of the invention. The objects and advantages of the invention may be realized and obtained by means of the instrumentalities and combinations particularly pointed out in the appended claims.

An apparatus capable of forming flat cut carton blanks into erect cartons with debowed carton side panels includes a forming head reciprocated through a die. During a descending forming stroke, the forming head receives a carton blank and directs the same through the die where forming guides bend the carton side panels and end panels into upright position relative to the carton bottom panel. The forming head includes relieved, opposing side walls; i.e. walls formed with cutout openings providing space for erected side panels to bend inwardly from the fold lines during engagement with pinching means positioned below the die. The pinching means projects into the path of the forming head to engage the carton side and bottom panels, capture the fold line and direct the erected side panels into the cutout openings, thereby creasing the fold line and overbreaking and debowing the side panels.

The side walls include an inclined surface extending along the lower periphery of the cutout openings. The surface includes a sharp, lower edge that engages and creases the fold line during contact with the pinching means. The surface extends inwardly from the lower edge at a predetermined angle and controls the overbreaking angle of the side panels.

The height of each cutout opening is sufficient to enable the upper edge of each carton side panel to clear the upper periphery of the opening so that the panels can bend inwardly without buckling during engagement with the pinching means.

The pinching means preferably includes a plurality of pinching wheels rotatably secured to support means positioned adjacent the forming guides of the die. Each pinching wheel includes a pinching notch having a leading edge positioned in the forming head path for engagement with the carton bottom panel during descending movement of the forming head. A trailing edge is engageable with the carton side panels as the carton continues to move and the pinching wheel rotates. The leading and trailing edges thus extend at an angle sufficient to effectively capture the fold line and pinch the carton side and bottom panel toward each other, thereby creasing the fold line in a controlled manner. An extension of the trailing edge presses against the side panel as the head continues to move down, further increasing the efficiency of the overbreaking action.

Wheel rotation caused by engagement between the pinching notch and carton occurs against the tension force of spring means. As the notch disengages from the carton, the wheel rotates in the opposite direction, thereby causing a release edge formed adjacent the leading edge of the pinching notch to slide by and gently release the carton side panel from the overbreaking position. This gentle release action prevents rapid snapping of the side panels into the final erected position (substantially perpendicular to the bottom panel) thereby relieving any strain on the locking tabs engaging the slits on the side panels.

The pinching wheels thereafter return to the home or fully retracted position with a shoulder in abutting engagement with stop pin means. A stripping edge formed adjacent and below the release edge is then positioned to engage and trap the upper edge of the carton side panels. The erected carton is thereby stripped from the forming head during the ascending return stroke.

Clearance notches are provided in the forming head side walls to prevent wearing contact of the pinching wheels during the ascending return stroke and improve pinching engagement between the pinching notches and portions of the carton side and bottom panels bridging the notches.

Still other objects of the present invention will become readily apparent to those skilled in the art from the following description wherein there is shown and described a preferred embodiment of this invention, simply by way of illustration of one of the best modes comtemplated for carrying out the invention. As will be realized, the invention is capable of other different embodiments, and its several details are capable of modifications in various, obvious aspects all without departing from the scope of the invention. Accordingly, the drawings and description are to be regarded as illustrative in nature and not as limiting.

BRIEF DESCRIPTION OF THE DRAWING

The accompanying drawings incorporated in and forming a part of the specification, illustrate several aspects of the present invention, and together with the description serve to explain the principles of the invention. In the drawings:

FIG. 5 is a view similar to FIG. 4 illustrating full capturing and pinching engagement of the fold lines, and pressing and overbreaking the side panels by the pinching wheels;

FIG. 6 is a view similar to FIG. 5 illustrating engagement of the pinching wheels against the carton side panels for gentle release; and FIG. 7 is a view similar to FIG. 6 but with the forming head ascending and the pinching wheels engaging the upper edge of the carton side panels to strip the erected carton from the forming head (cf. fifth sequential view of FIG. 1).

DETAILED DESCRIPTION OF THE INVENTION

Figure 1:
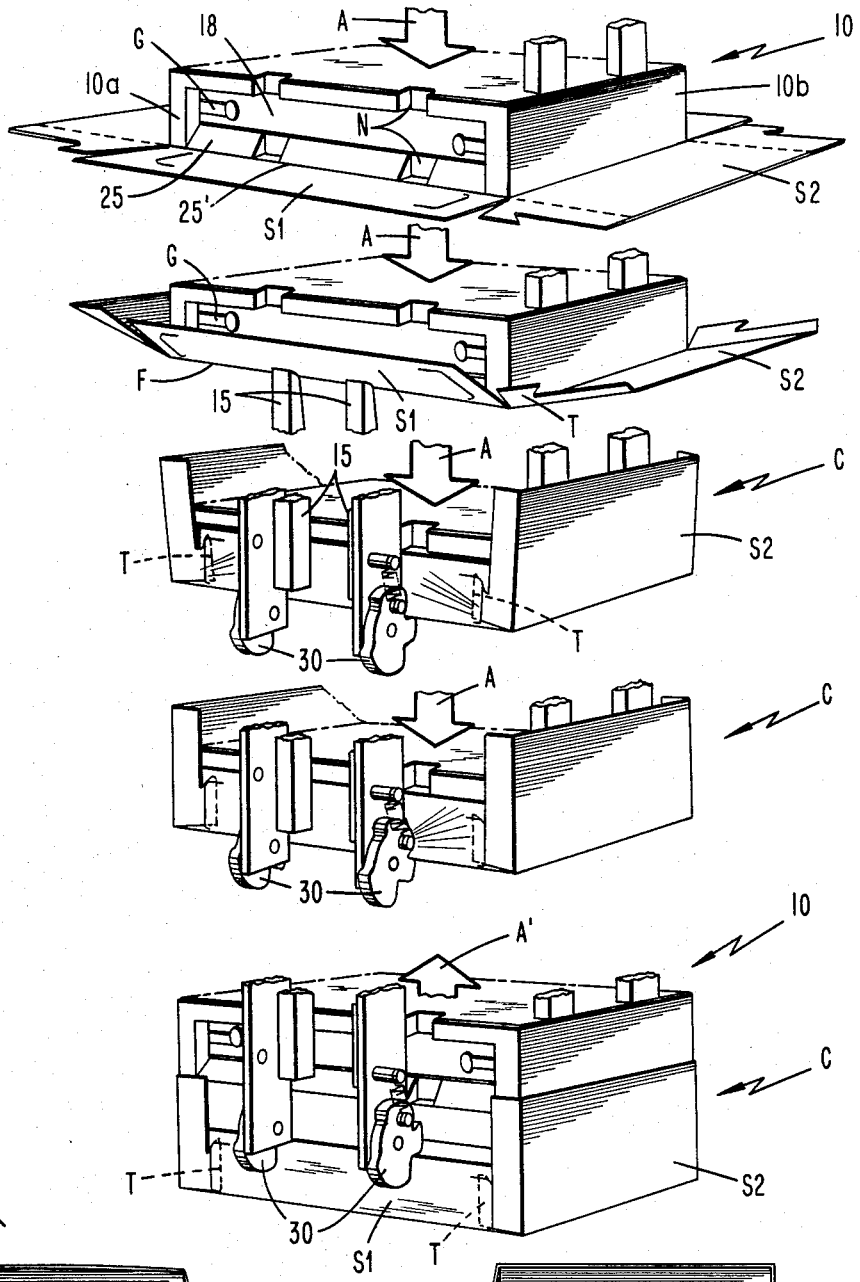
FIG. 1 is a series of perspective views of a combined forming and debowing apparatus in accordance with the invention showing progressive locations of the forming head and the carton during the descending forming stroke in relation to the pinching wheels and stripping of the carton on the ascending stroke.

Referring to Composite FIG. 1, a forming head, generally designated by reference numeral 10, is used to direct or plunge a flat cut carton blank through a suitable die to form erected cartons C. The cartons are usually plastic coated paperboard, for packaging bakery products, frozen foods or the like, and include opposing pairs of side panels S1 and relatively shorter end panels S2 attached to a bottom panel B along fold lines F therebetween, forming a rectangular body (see FIG. 2 also).

Figure 2A:
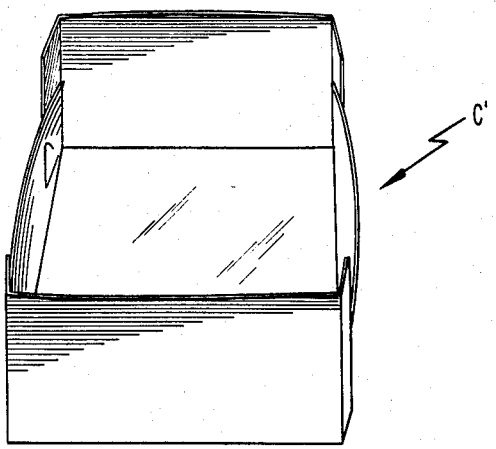
Fig. 2a PRIOR ART
FIG. 2*a* is a perspective view of an erected carton formed with prior art apparatus and methods, resulting in outwardly bowed carton side panels.
Figure 2:
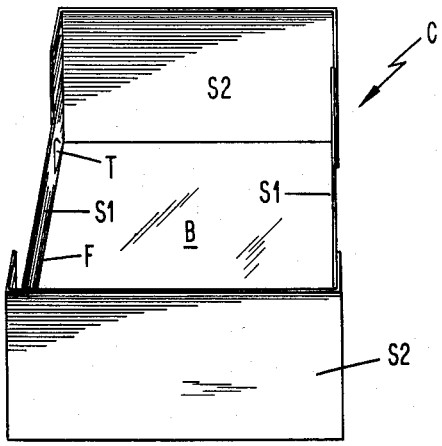
FIG. 2 is a perspective view of an erected carton formed with the apparatus and method of the present invention resulting in debowed side panels.

In accordance with various features of the invention set forth below, the carton side panels S1 are debowed after forming to stand upright in relation to the carton bottom panel B, as shown in FIG. 2 (cf. carton C′ of prior art in FIG. 2*a*). Thusly debowed, a lid (not shown) can be positively seated in flush engagement on the side panels and end panels to cover the carton mouth and fully seal the contents.

Forming head 10 includes a pair of side walls 10*a* and end walls 10*b* (one each shown in FIG. 1) corresponding respectively in length to the carton side panels S1 and end panels S2. The walls 10*a* and 10*b* of the head define a generally rectangular block with an under side corresponding to the carton bottom panel B.

Figure 3:
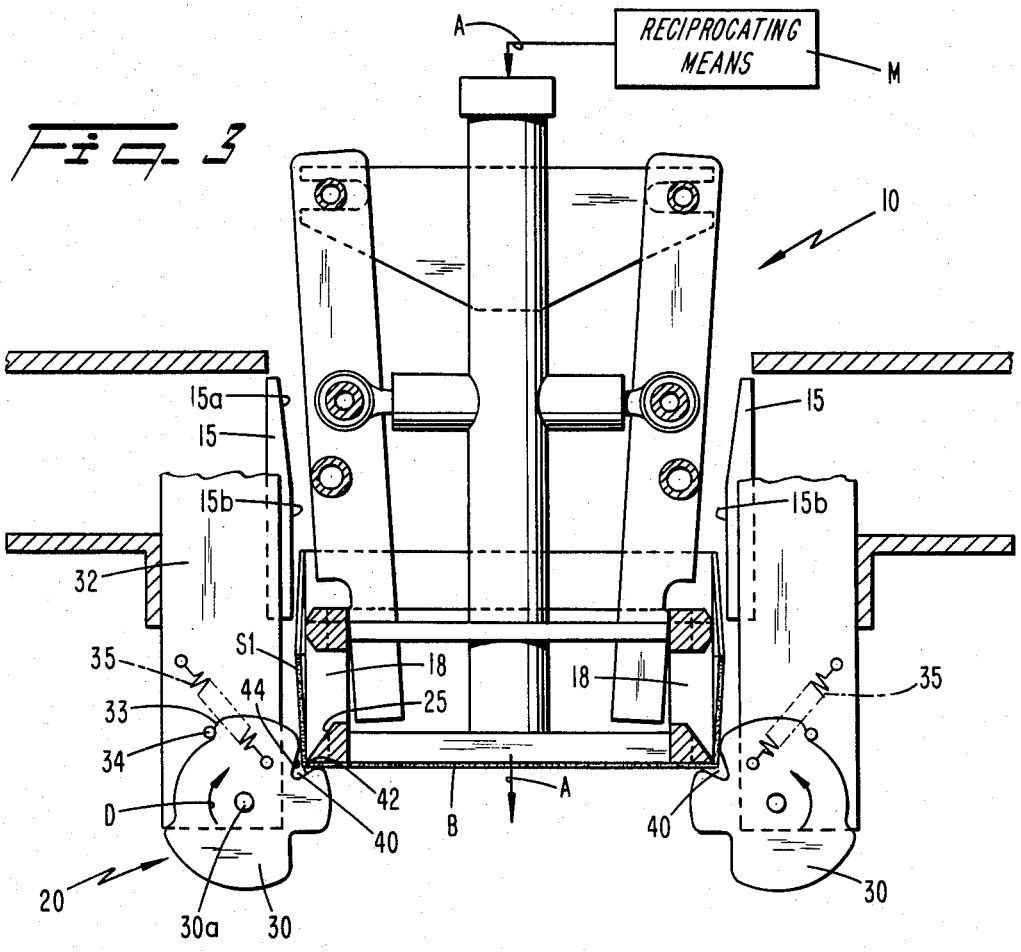
FIG. 3 is a cross-sectional view of the forming head of the present invention showing the carton side panels and forming head descending into initial engagement with the pinching wheels (cf. third sequential view of FIG. 1)

A reciprocating means M (as shown in FIG. 3) drives forming head 10 in a descending stroke, as indicated by arrows A (see FIGS. 1 and 3–6), to form the erected carton C. An ascending return stroke (see arrow A′ in FIGS. 1 and 7) also achieved with the moving means M, thereafter returns forming head 10 to an upper, carton blank receiving position for erecting the next in-line blank of a continuing carton forming operation.

In the uppermost position, a carton blank is positioned in the path of forming head 10 with a suitable feeder mechanism (not shown) so that carton bottom panel B engages the under side of the head. Next, the head begins its descending forming stroke with a captured carton blank to direct the same through a die.

Figure 4:
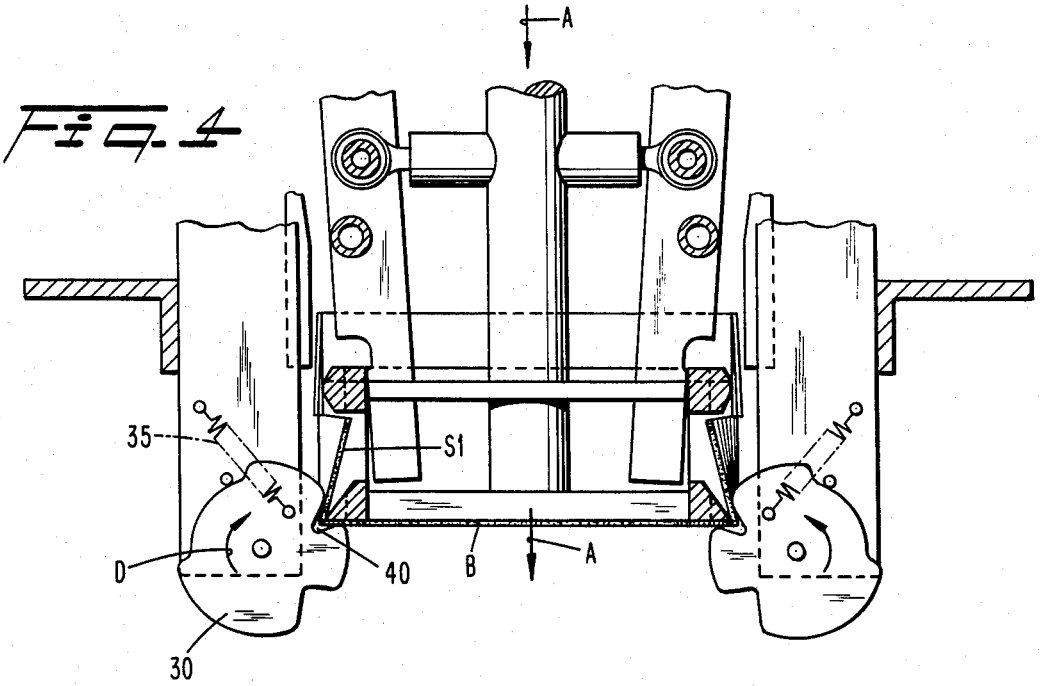
FIG. 4 is a cross-sectional view similar to FIG. 3 showing portions of the carton side and bottom panels entering the pinching notch in pinching engagement and capturing of the fold line (cf. fourth sequential view of FIG. 1)

As best shown in the next two sequential perspectives of FIG. 1 and in FIGS. 3 and 4, the die includes a plurality of side forming guides 15 positioned immediately adjacent the forming path. The guides 15 are substantially parallel to the forming head side walls 10*a*. As the forming head 10 descends between guides 15, the flat carton side panels S1 engage these guides and are gradually forced upwardly into upright erected condition relative to bottom panel B, along the fold lines F. Suitable additional forming guides (not shown) may be used for the sides, as well as the ends, to bend carton panels S1, S2 into erected position. Stripping fingers G strip or pull the locking tabs T into the slits provided on side panels S1 (see FIG. 1 and 2).

Inwardly directed guide edges 15*a* of guides 15 (see FIG. 3) taper downwardly along the forming path so as to provide gradual bending engagement with fold lines F. This feature assures smooth and gradual bending movement of carton side panels S1 with no damage to the side panels and to assure reliable, high speed production. The guide edges 15*b* (formed below edges 15*a*) of guides 15 are parallel to the forming head side walls 10*a* so as to bend the side panels S1 into substantially parallel engagement with the side walls. This engagement positions the carton side panels S1 relative to the carton bottom panel B (see FIG. 4). However, at this point in the forming process, the actual appearance of the erected carton sides would resemble the carton sides shown by carton C' in FIG. 2*a*, if the carton is removed without further operation.

A rectangular cutout opening 18 is provided in each forming head side wall 10*a*. Cutout openings 18 advantageously provide space to allow the erected side panels S1 to bend inwardly from fold lines F, into the openings, when the side panels are engaged by a pinching means 20. This provides overbreaking action of the side panels S1 at the fold lines F so that when released the panels return to be substantially perpendicular (see FIG. 2).

Each cutout opening 18 extends across a major portion of side wall 10*a*, and includes an inclined overbreaking surface 25 defining the lower peripheral edge of the opening. As shown in FIG. 1, the surface 25 extends inwardly into the opening 18 from a relatively sharp lower creasing edge 25'. Creasing edge 25' is in engagement with the inside of fold line F of the carton and in the plane of side wall 10*a*. The edge 25' serves as the pivoting point for the carton side panel S1 at the fold line F during the forming stroke. The surface 25 advantageously serves to control maximum overbreaking movement of the side panels S1 in the manner described below. The height of each opening 18, as measured from edge 25', is sufficient to allow each entire side panel S1 to bend inwardly from the fold line F without interference, thereby avoiding undesirable buckling effects.

A plurality of clearance notches N (see FIG. 1) are provided in side walls 10*a* in alignment with pinching means 20. Notches N serve to allow ascending movement of forming head 10, after stripping occurs, without engaging the pinching means 20. This feature serves to prevent undesirable wearing contact of the pinching means with side walls 10*a*. In the event forming head 10 performs a descending forming stroke without an accompanying carton, contact is also prevented by allowing the pinching means 20 to pass through the notches.

More importantly, since portions of carton side panel S1, fold line F and bottom panel B bridge across notches N (in the planes coincident with inclined surface 25, edge 25' and the under side of forming head 10, respectively), pinching means 20 can advantageously engage these bridging portions, thus capturing the fold line and pinching the side and bottom panels toward each other. This action creases the fold line F in a positive and controlled manner.

More specifically, the pinching means 20 preferably includes spring-loaded pinching wheels 30 positioned transversely in relation to descending carton side panels S1. As best shown in FIG. 3, each wheel 30 is rotatably secured to a vertical support bar 32, on pin 30*a*. Support bars 32 are located parallel and adjacent forming guides 15 in spaced relationship from the forming head path, so as to align each wheel 30 with the corresponding clearance notch N.

Each pinching wheel 30 is provided with a unique, contoured peripheral edge, advantageously performing three functions, as listed in order of operation: (1) pinching carton side panels S1 and bottom panel B in the area of notch N to capture and crease fold lines F; (2) bending or camming the carton side panels inwardly into openings 18 in overbreaking engagement; and (3) stripping the formed cartons C from the forming head 10.

To explain the pinching operation, each wheel 30 is initially maintained in a home or fully retracted position with a shoulder 33 in abutting engagement with a stop pin 34 attached to the bar 32. The shoulder 33 is formed in the edge to limit wheel rotational movement for effective stripping action after overbreaking occurs, as discussed below. Shoulder 33 is biased into engagement with the pin 33 under the tension force of a spring 35.

As shown in FIG. 3, each pinching wheel includes a pinching notch 40 having a leading edge 42 and a trailing pinching edge 44. The edges 42, 44 extend into the wheel at an angle sufficient to effectively capture fold line F and pinch the cartonside panels S1 and bottom panel B toward each other. The angle is preferably slightly less than the angle of inclination of inclined surface 25, (in relation to the under side of forming head 10). This assures tight engagement and pinching of the carton panels.

When the pinching wheel 30 is in the home position (see FIG. 3), that is, during the descending motion of the forming head, the leading edge 42 projects into the forming head path for engagement with the bottom panel B of the carton C. As the carton C and forming head 10 descend, carton bottom panel B does positively engage the leading edge 42, as shown in FIG. 3. Fold line F is captured and adjacent portions of the carton side and bottom panels S1, B simultaneously enter the notch 40. As carton C continues to descend in smooth, uninterrupted descending movement, the pinching wheel 30 rotates in the clockwise direction (see FIGS. 3 and 4 and arrow D), against the tension force of spring 35. Trailing edge 44 thereby moves to gently and positively engage and press side panels S1 into openings 18 and onto inclined surface 25 in overbreaking engagement (see FIGS. 4 and 5).

As briefly explained above, engagement between pinching notch 40 and carton C occurs at carton side and bottom panel portions bridging the clearance notches N. Since the angle of notch 40 is slightly less than the inclination angle of the surface 25 (i.e., approximately 45°) this feature allows the trailing edge 44 to gently yet firmly pinch the side panels S1 slightly into the notches N, while bottom panel B is controlled by leading edge 42. In this manner, pinching engagement serves to positively crease the carton side panels S1 at fold lines F, along the sharp creasing edge 25' (see FIG. 5). This controlled procedure of creasing fold lines F with pinching pressure greatly increases the overbreaking efficiency action. The stiffness characteristics of the paperboard at the fold line F are positively overcome and from this action alone, the side panel bowing problem is substantially overcome.

The overbreaking action provided by wheels 30 is limited by the inclination of surface 25. In this manner, controlled overbreaking of the side panels S1 is obtained and the panels spring back to the desired, substantially upright, debowed condition relative to the carton bottom panel, as shown in FIG. 2. In other words, the feature of providing a cutout opening 18 with an inclined overbreaking surface 25 formed in each side wall 10*a*, in combination with pinching wheels 30, serves to assure that the carton side panels S1 overbreak into debowed condition in a gentle and uniform manner during the forming stroke.

As the carton C and forming head 10 continue to descend, the leading edge 42 begins to rotate out of engagement with carton bottom panel B. However, as this withdrawal action occurs, overbreaking pressure is still being applied by the trailing edge 44 engaging the outer surface of carton side panels S1 (see FIG. 5). A raised edge extension 44' advantageously continues the overbreaking action as the rotational momentum of the wheel 30 (in the clockwise direction of FIG. 5) carries said edge against the side panel S1 while in the opening 18. This edge extension 44' thus has a profile effective to press or cam the side S1 against the surface 25 as the carton continues to move downwardly. The limit of rotational movement of the wheel 30 is provided by shoulder 33' engaging stop 34 (see FIG. 5).

The tension force exerted by spring 35 eventually overcomes the clockwise rotational force. The wheel 30 thus begins to rotate in the reverse direction toward the fully retracted position, that is in the counterclockwise direction, as shown in FIG. 6 (see arrow $D_1$). Of course, the desired operative tension in the spring 35 may be selected to match the critical parameters of the particular forming operation, such as, forming head speed, the particular configuration of the edge and the mass of the wheel 30.

As wheel 30 moves in reverse to return to the home position, a release edge 50 formed adjacent leading edge 42, slides gently against the outer surface of carton side panels S1. This provides gentle release action thereby preventing rapid snapping of the side panels into the debowed position (see FIG. 2). As a result, any strain on the locking tabs engaging the slits on the side panels is minimized. Since release edge 50 engages the panels S1 in low friction, sliding movement, marring or scuffing action is advantageously avoided.

The releasing action of side panels S1 into debowed position provided with release edge 50 is complete when wheels 30 return to home position with shoulder 33 in abutting engagement with pin 34, as shown in FIG. 7. Release edge 50 is now completely disengaged from side panels S1, with the side panels S1 now completely debowed. As shown in FIG. 7, a stripping edge 55, formed adjacent and below release edge 50, is now positioned in the forming head path to engage and trap the upper free edges of carton side panels S1 immediately after debowing occurs. This engagement coincides with the completion of the descending forming stroke. Thereafter, ascending return movement of forming head 10 allows wheels 30 to strip the erected carton C from the forming head and onto a suitable conveyor mechanism (not shown).

As the forming head continues to ascend after stripping, pinching wheels 30 slide through clearance notches N provided in the forming head side walls, as mentioned above.

The foregoing description of the preferred embodiment of the invention has been presented for purposes of illustration and description. It is not intended to be exhaustive or to limit the invention to the precise form disclosed, and obviously many modifications and variations are possible in light of the above teaching. The embodiment is chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. In an apparatus for forming flat cut carton blanks into erect cartons having side panels attached to a bottom panel along fold lines therebetween, said side panels including side panel locks for maintaining the cartons in the erect condition, said apparatus including a forming head having opposed side walls, and reciprocating moving means enabling the forming head to receive and direct a carton blank through a die into erected condition with the side panels of the carton engaging the side walls, the improvement comprising:

(a) cutout openings formed in said side walls allowing the directed side panels to bend inwardly from the fold lines;

(b) pinching means operatively positioned in the path of the forming head to engage the carton bottom panel and side panels in pinching engagement during downward movement of the forming head so as to capture and crease the fold lines and direct the erected side panels into the cutout openings, thereby overbreaking and debowing the carton side panels; and (c) stripping means on said pinching means, said stripping means serving to strip the erected carton from the forming head during upward return movement of the forming head.

2. In an apparatus according to claim 1, wherein said side walls further include an inclined surface defining the lower periphery of the cutout openings, said surface having a substantially sharp creasing edge engageable with the fold lines to thereby crease the fold lines during engagement with the pinching means.

3. In an apparatus according to claim 2, wherein said inclined surface is upwardly tapered at a predetermined angle, thereby allowing the side panels to bend inwardly onto the surface into inclined position corresponding to the predetermined angle during overbreaking operation.

4. In an apparatus according to claim 1, wherein said stripping means on said pinching means includes a stripping edge positioned in the forming head path to engage an upper edge of the carton side walls after overbreaking action occurs when the pinching means is in a home position, to thereby strip the erected and debowed carton from the forming head during an ascending return stroke of the forming head.

5. In an apparatus according to claim 4, wherein said pinching means includes a pinching wheel having a pinching notch, said pinching wheel being rotatably mounted adjacent the forming head path.

6. In an apparatus according to claim 5, wherein said pinching notch includes a leading edge positioned in the forming head path to engage the carton bottom panel and a pinching trailing edge engaging the carton side panel during rotation of the pinching wheel.

7. In an apparatus according to claim 6, wherein said trailing edge includes an extension edge being engageable with the carton side panel as the pinching notch disengages from the descending carton to complete the overbreaking action.

8. In an apparatus according to claim 1, wherein said pinching means further includes a release edge engageable with the side panel during reverse rotation of the pinching means during ascending movement of the forming head to thereby gently release the carton side panel into the upright position after overbreaking action occurs.

9. In an apparatus of claim 8, wherein is provided spring means including a tension spring interconnecting the pinching means to support means to provide the reverse rotation.

10. In an apparatus according to claim 9, wherein said pinching means includes a shoulder and a stop pin on the support means to define a home position of the pinching means.

11. In an apparatus according to claim 1, said cutout openings having a height enabling an upper edge of each side panel to clear an upper periphery of the cutout opening and bend inwardly without buckling during engagement with the pinching means.

12. In an apparatus according to claim 3, wherein said inclined surface includes a clearance notch aligned with the pinching means, said notch enabling a portion of the carton side panels and bottom panels to bridge across the notch to allow the pinching means to capture the fold line and engage the bridging portions, thereby creasing the fold lines and overbreaking the side panels.

13. In an apparatus according to claim 4, wherein said clearance notch enables the pinching means to pass through the notch and thereby avoid contact with the forming head during an ascending return stroke of the forming head.

14. A method for debowing side panels of an erected carton formed from flat cut carton blanks having a bottom panel and fold lines between the bottom panel and side panels, said side panels including side panel locks for maintaining the cartons in the erect condition, said carton blanks being formed on an apparatus including pinching wheels and a forming head for receiving and directing the carton blank with reciprocating moving means through a die having forming guides, comprising the steps of:

(a) erecting the carton blank to a partially erected position by moving the forming head in a descending forming stroke in response to reciprocating means, (b) passing the partially erected carton through the side forming guides so as to allow the carton side panels to engage the forming guides and bend upwardly into upright position relative to the bottom panel, said side panels thereby engaging side walls of the forming head;

(c) pinching the erected carton side panels inwardly from the fold lines into cutout openings formed in the forming head side walls with pinching wheels, thereby capturing and creasing the fold lines in pinching engagement and overbreaking the side panels;

(d) discontinuing the pinching step during continued descending movement of the forming head, thereby enabling the side panels to assume a debowed position relative to the carton bottom panel; and (e) stripping the erected carton from the forming head by engaging the upper edges of the carton side panels with the pinching wheels prior to the ascending return stroke of the forming head.

15. The method according to claim 14, including the further step of pressing the carton side panels inwardly from the fold lines after pinching the fold lines.

16. The method according to claim 14, including the further step of gently releasing the carton side panels from an overbreaking position.

17. The method according to claim 14, wherein the pinching step and pressing step further require pressing the erected carton side panels onto inclined surface means extending into the cutout openings at a predetermined angle, thereby controlling the degree of overbreaking of the side panels.

* * * * *